313-422 SR
5/5/81 OR 4,266,159

United States Patent [19]

Siekanowicz

[11] 4,266,159

[45] May 5, 1981

[54] ELECTRON CURRENT COLLECTOR FOR FLAT PANEL DISPLAY DEVICES

[75] Inventor: Wieslaw W. Siekanowicz, Lawrenceville, N.J.

[73] Assignee: RCA Corp., New York, N.Y.

[21] Appl. No.: 80,104

[22] Filed: Sep. 28, 1979

[51] Int. Cl.[3] ..... H01J 29/08

[52] U.S. Cl. ..... 313/422

[58] Field of Search ..... 313/422; 315/366

[56] References Cited

U.S. PATENT DOCUMENTS 4,216,407 8/1980 Vaccaro ..... 313/422

*Primary Examiner*—Robert Segal

*Assistant Examiner*—Darwin R. Hostetter

*Attorney, Agent, or Firm*—Eugene M. Whitacre; Dennis H. Irlbeck; Lester L. Hallacher

[57] ABSTRACT

A cathodoluminescent display device is composed of a plurality of channels. Each of the channels includes spaced guide meshes between which electrons from an electron gun are propagated as beams. At the end of the channels away from the electron gun is a collector and a deflection electrode. The guide meshes are extended between the collector and deflection electrode. Collection apertures in the extended portions pass electrons to the collector. Collection of the electrons by the collector generates a signal which is sensed and used to maintain uniformity of the characteristics of the beams.

15 Claims, 3 Drawing Figures

ELECTRON CURRENT COLLECTOR FOR FLAT PANEL DISPLAY DEVICES

BACKGROUND OF THE INVENTION

This invention relates generally to flat panel image display devices and particularly to means for reducing electron back scatter in such devices.

U.S. Pat. No. 4,121,137 issued to Thomas L. Credelle, discloses a system for achieving image brightness uniformity in a flat panel display device. In the Credelle system, the display device is divided into a plurality of channels and electron beams are propagated along the channels. The beam currents of the channels are sensed by a collector and the signals obtained by the sensing are used to adjust the beam currents and to achieve uniformity of image brightness across the viewing area of the display device. The construction and location of the collector do not reduce back scatter of secondary emission electrons and stray electrons at the end of the beam guide meshes, and thus an optimal display may not be achieved in all instances.

Copending application Ser. No. 956,663, filed Nov. 1, 1978 by Frank E. Vaccaro, entitled "Flat Panel Display With Beam Collector" now U.S. Pat. No. 4,216,407 discloses a flat panel display device of the type disclosed in U.S. Pat. No. 4,121,137. In the device disclosed in the copending application Ser. No. 956,663, the ends of the beam guides remote from the cathode are extended. The extended portion of the beam guide nearest the phosphor screen contains no apertures while the extended portion of the beam guide nearest the back panel contains apertures which are substantially larger than the other apertures in the beam guides. A beam collector/pad which is coplanar with the extraction electrodes spans the enlarged apertures. The extended portion of the unapertured beam guide serves as a shield and the beam collector/pad collects electron beams and generates a current which is used to maintain uniform brightness across the display screen.

SUMMARY OF THE INVENTION

In a multielectron beam display device wherein electron beams are propagated between electron beam guide meshes, an electron current collector is arranged in the proximity of the beam guides. The beam guides are extended beyond the display area and the collector is arranged substantially parallel to the extended portion of the beam guides. A deflection electrode is positioned so that the extended portions of the beam guides lie between the collector and deflection electrode to substantially eliminate electron backscatter in the device.

DETAILED DESCRIPTION OF THE PREFERRED EMBODIMENT

Figure 1:
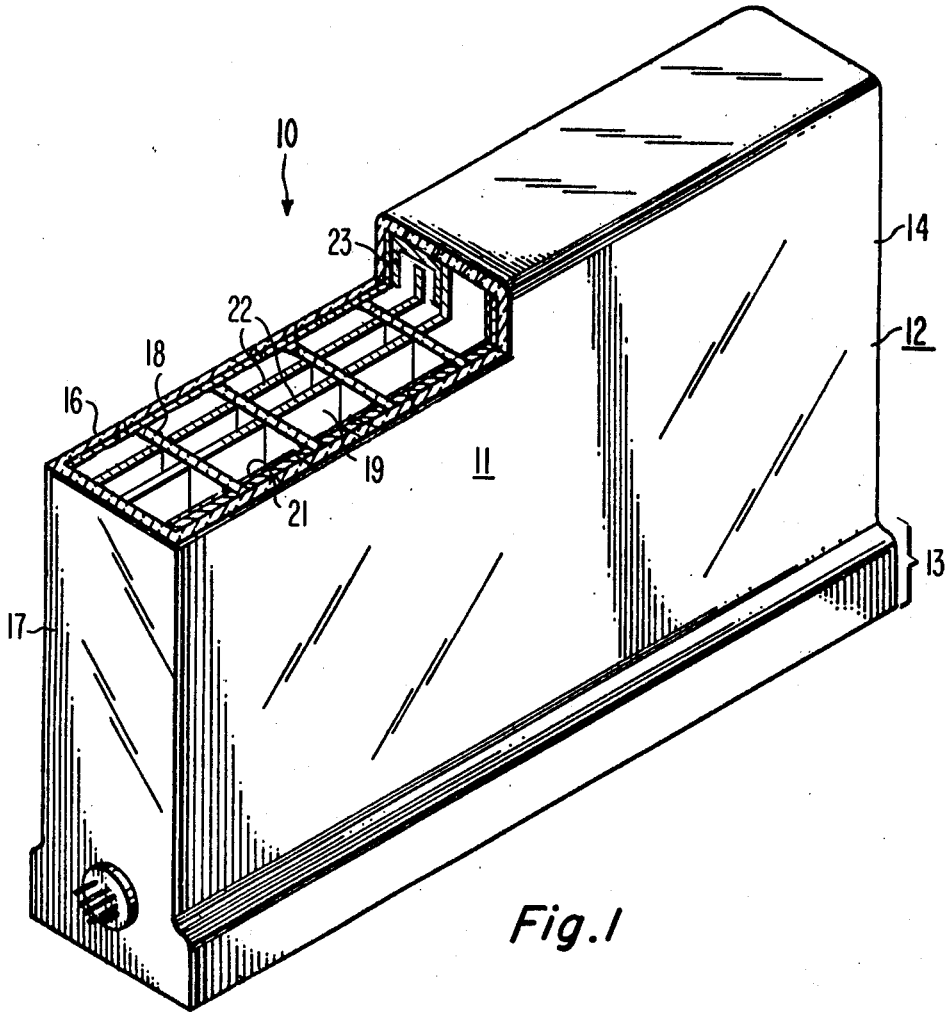
FIG. 1 is a partial cut-away section of a prior art multielectron beam display device.

FIG. 1 shows one form of a flat panel display device in which the present invention can be utilized. In FIG. 1, the display device is generally designated as 10 and includes an evacuated envelope 11 having a display section 12 and an electron gun section 13. The display section 12 includes a rectangular front panel 14 which supports the viewing screen and a rectangular back wall 16 in a spaced parallel relationship with the front wall 14. The front wall 14 and the back wall 16 are connected by sidewalls 17.

A plurality of spaced parallel vanes 18 are secured between the front wall 14 and the back wall 16 extending from the gun section 13 to the opposite sidewall 17. The support vanes 18 provide the desired internal support for the evacuated envelope 11 against external atmospheric pressure and divide the display section 12 into a plurality of channels 19. On the inner surface of the front wall 14 is a phosphor screen 21. A plurality of guide meshes 22 are arranged in each of the channels 19 for confining the electrons from the gun section 13 into beams which travel along the channels 19 between the guide meshes 22. The channels also include means for deflecting the beams out of the guide meshes through one of a plurality of small apertures in the guide meshes 22 and toward the phosphor screen 21 at various points along the length of the channels 19. At the ends of the channels 19, which are remote from the electron gun section 13, is an electron collector 23. The collector 23 is a U-shaped electrode which extends the full width of the device 10 across the ends of the channels 19.

Figure 2:
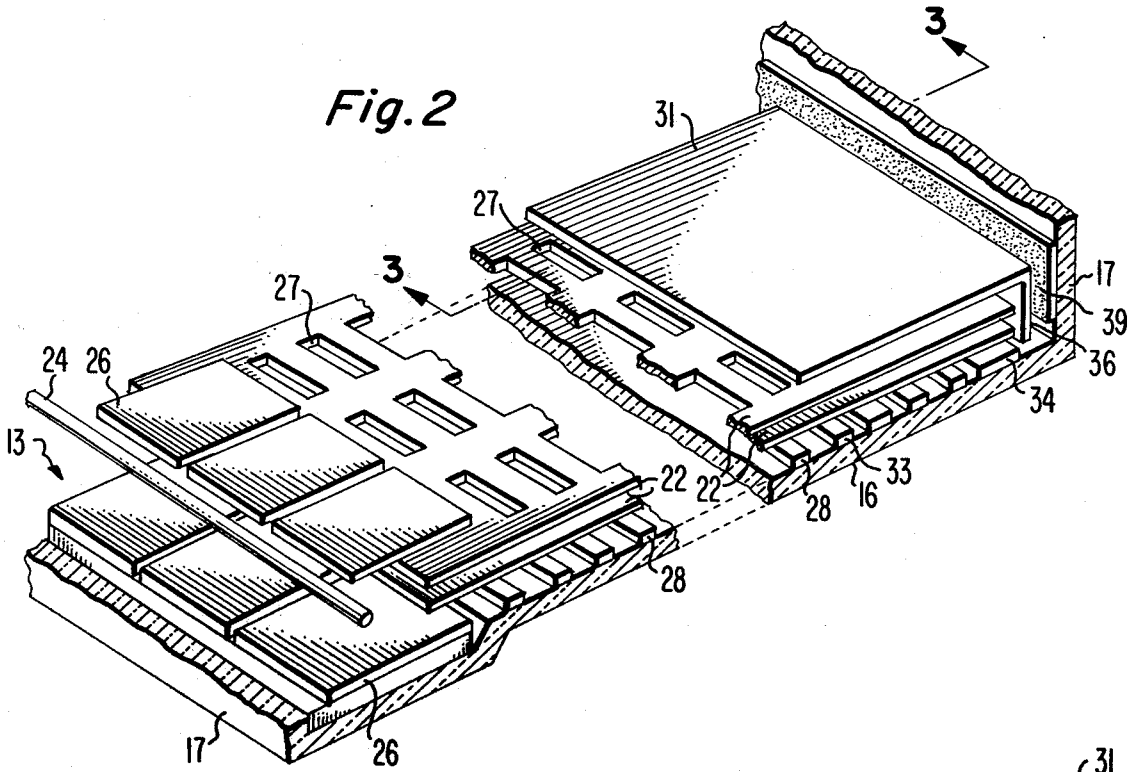
FIG. 2 is a perspective view partially broken away of a preferred embodiment of the invention.
Figure 3:
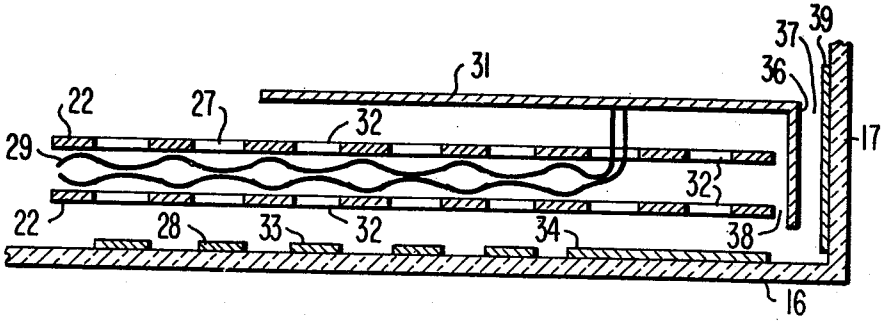
FIG. 3 is a section view taken along line 3—3 of FIG. 2.

As shown in FIG. 2, the electron gun section 13 includes a cathode 24 and a plurality of modulation electrodes 26. The cathode 24 is electrically energized to an elevated temperature to emit electrons. The modulation electrodes 26 are biased so that the electrons emitted by the cathode 24 are attracted into the space between the parallel guide meshes 22. The guide meshes 22 also are biased so that the electrons propagate as beams between the guides along longitudinal rows of focusing apertures 27 formed in the guide meshes 22. A plurality of extraction electrodes 28 are supported by the back panel 16. The extraction electrodes 28 are positioned directly beneath the focusing apertures 27 and extend transversely across the entire width of the channel 19. As shown in FIG. 3, as the electron beam 29 propagates between the guide meshes 22 the beam 29 is focused between the focusing apertures 27 of the guide meshes 22. This focusing is partially achieved by the application of positive biasing voltages to the extraction electrodes 28. When it is desired to extract the electron beam 29 from between the guide meshes 22, a negative voltage is applied to one of the extraction electrodes 28. This voltage repels the electron beam 29 and the beam passes through the focusing aperture directly above the negatively biased extraction electrode.

Also, as shown in FIG. 3, an electron collector 31 is parallel to and spaced from portions of the guide meshes 22 which extend beyond the viewing area of the display section 12. The extended portions of the guide meshes contain a plurality of collection apertures 32 which are longitudinally aligned with the focusing apertures 27. The collection apertures also are arranged in rows transversely across the guide meshes 22. A plurality of collection electrodes 33 are coplanar with the extraction electrodes 28 and are parallel to the transverse rows of the collection apertures 32. The individual collection electrodes 33 are positioned to span one of the collection apertures 32. One collection electrode 34 is larger than the other collection electrodes 33 and spans the two collection apertures 32 which are nearest to the sidewall 17. The larger electrode 34 is a deflection electrode for deflecting electrons to the collector 31. Preferably, the collector 31 and collection electrodes 33 are spaced equal distance about the center of the space between the guide meshes 22. Also, because the extended portions of the guide meshes 22 are located outside of the viewing area of the display section 12, the collector 31, the collection electrodes 33 and the deflection electrode 34 also are located outside of the viewing area. Accordingly, the focusing aperture 27 which is closest to the collector 31 is the furthest aperture from the gun section 13 to pass electrons which contribute to the visual display. Any electrons which travel past this focusing aperture pass beneath the collector 31 until they reach the collection aperture 32 which is above the deflection electrode 34. By biasing the deflection electrode with a negative voltage the beam is deflected upwardly and impacts the collector. The electrons impacting with the collector 31 will form a charge on the collector. This charge can be sensed in the manner described in U.S. Pat. No. 4,121,137 and used to maintain uniform brightness of the visual display or for any other desired purpose.

FIG. 3 shows several features which can be used in along with the collector 31. One modification includes bending the collector 31 to include an end tab 36 which is substantially perpendicular to the collector 31. The end tab 36 is dimensioned to span the space between the guide meshes 22 and is spaced from the end wall 17 by a small space 37. The tab 36 is an integral part of the collector 31 and thus is biased at the same potential as the collector 31. For this reason the space 38 between the guide meshes 22 and the tab 36 is kept to the minimum which prevents arcing and other unwanted affects across the space 38.

If desired the tab 36 can be eliminated and replaced by a conductive surface 39 which is deposited on the inside of sidewall 17. The conductive surface is dimensioned to span the guide meshes 22 and should be at least as high as the collector 31. The conductive surface 39 is biased at a potential which is more positive than the collector 31.

If desired both tab 36 and conductive surface 39 can be used. In such an instance the spacing 37 between the tab and conductive surface is the minimum which prevents arcing and other unwanted affects across the space 37.

In operation, the collection electrodes 33 are maintained at the same positive voltage as the extraction electrodes 28. Because the collection electrodes 33 are maintained at the same biasing potential, if desired a single electrode which spans all of the collection apertures 32 can be used in place of the plurality of individual electrodes shown in FIGS. 2 and 3. The use of a single electrode would be preferable from a fabrication viewpoint and would not change the operation of the system. When the collector 31 and the collection electrodes 33 are equal distance from the guide meshes 22, the collector 31 is biased at the same voltage as the collection electrodes 33. This biasing maintains focusing of the beam 29 beyond the viewing area of the display section 12. If different spacing of the collector 21 and the collection electrodes 33 is used, the biasing voltage on the collector 31 must be increased or decreased, according to the change in the spacing, to maintain the focusing of the beam 29. The deflection electrode 34 is maintained at a potential which is the minimum potential required to cause the ejection of the electron beam 29 from the space between the guide meshes 22, typically, this will be in the order of −20 volts. The continued focusing of the electron beam beneath the collector 31 causes the beam to propagate between the guide meshes until the collection aperture 32 which is above the deflection electrode 34 is reached. The voltage on the deflection electrode 34 repels the beam and the beam passes through the collection aperture 32 in the top guide mesh 22 and impacts the collector 31. Several of the collection apertures 32 separate the last focusing aperture 27 and the collection aperture 32 through which the electron beam is deflected. This separation and the continued focusing of the beam beneath the collector 31 prevent scattered electrons and secondary emission electrons from passing through one of the focusing apertures 27 or between the collector 31 and the upper mesh 22 and impacting the phosphor screen on the viewing surface 14. Also, electrons can pass through any of the collection apertures 32 and impact the collector 31. The use of either the tab 36 or the conductive surface 39 will prevent any secondary emission or stray electrons from escaping from the space between the guide meshes 22 and finding their way to the viewing area through the space between the upper guide mesh and the collector. For these reasons, the invention substantially reduces electron leakage to the viewing screen resulting in an improved visual display.

What is claimed is:

1. In a flat panel display device having a display area where the impact of electrons effects a visual display, and including a plurality of spaced beam guides for propagating and focusing electron beams, said beam guides including extraction apertures through which said electron beams pass to impact said display area, said display device also including extraction electrodes for repelling said electron beams through said extraction apertures, an improvement comprising:

an electron collector arranged substantially parallel to the plane of said beam guides and spaced from said beam guides on the display area side of said beam guides;

a deflection electrode in the plane of said extraction electrodes and substantially parallel to the plane of said beam guides;

said beam guides having an extended propagation and focusing portion extending beyond said display area and arranged between said electron collector and said deflection electrode so electron beams are focused between said collector and said deflection electrode, said extended portion including at least one collection aperture so that said deflection electrode causes said electron beams to pass through said collection aperture and impact said collector.

2. The display device of claim 1 wherein there are a plurality of said collection apertures and said deflection electrode spans at least two of said collection apertures.

3. The display device of claim 2 wherein said electron collector and said deflection electrodes are equally spaced from said beam guides.

4. The display device of claim 3 further including a plurality of collection electrodes arranged between said extraction electrodes and said deflection electrode, and a plurality of additional collection apertures aligned with said collection electrodes.

5. The display device of claim 4 wherein said extraction electrodes, said collection electrodes and said collector are biased at substantially the same voltage to maintain focusing of said electron beams in said extended portion, and wherein said deflection electrode is biased differently from said collection electrodes.

6. The display device of claim 5 wherein there are at least three of said additional collection apertures.

7. The display device of claim 2 further including a plurality of collection electrodes arranged between said extraction electrodes and said deflection electrode, and a plurality of additional collection apertures aligned with said collection electrodes.

8. The display device of claim 7 wherein there are at least three of said additional collection apertures.

9. The display device of claim 6 wherein said deflection electrode is the last electrode in the direction of propagation of electron beams.

10. The display device of claim 1 wherein said electron collector includes a tab arranged to span the space between said beam guides.

11. The display device of claim 1 further including a conductive surface arranged to span the space between said beam guides.

12. The display device of claim 10 further including a conductive surface arranged to span the space between said beam guides.

13. The display device of claim 2 further including a plurality of additional collection apertures arranged between said extraction apertures and said collection apertures and further including a collection electrode spanning said additional collection apertures.

14. The display device of claim 10 further including a plurality of additional collection apertures arranged between said extraction apertures and said collection apertures and further including a collection electrode spanning said additional collection apertures.

15. The display device of claim 11 further including a plurality of additional collection apertures arranged between said extraction apertures and said collection apertures and further including a collection electrode spanning said additional collection apertures.

* * * * *